US010903583B2

(12) United States Patent
Mahoney

(10) Patent No.: US 10,903,583 B2
(45) Date of Patent: Jan. 26, 2021

(54) NONPLANAR METAMATERIAL POLARIZER AND ANTENNA SYSTEM

(71) Applicant: BAE SYSTEMS Information and Electronic Systems Integration Inc., Nashua, NH (US)

(72) Inventor: David A. Mahoney, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 311 days.

(21) Appl. No.: 16/011,227

(22) Filed: Jun. 18, 2018

(65) Prior Publication Data

US 2019/0386398 A1 Dec. 19, 2019

(51) Int. Cl.

| | |
|---|---|
| ***H01Q 21/00*** | (2006.01) |
| ***H01Q 15/24*** | (2006.01) |
| ***H01Q 13/02*** | (2006.01) |
| ***H01Q 1/38*** | (2006.01) |
| *H01P 1/17* | (2006.01) |

(52) U.S. Cl.

CPC ..... *H01Q 21/0056* (2013.01); *H01Q 1/38* (2013.01); *H01Q 13/0258* (2013.01); *H01Q 15/244* (2013.01); *H01P 1/172* (2013.01); *H01P 1/173* (2013.01)

(58) Field of Classification Search

CPC ..... H01Q 21/00; H01Q 1/38; H01Q 13/02; H01Q 15/24

USPC ..... 343/702

See application file for complete search history.

(56) References Cited

U.S. PATENT DOCUMENTS 8,599,101 B2 * 12/2013 Christie ..... H01Q 1/243 343/895

2003/0151556 A1 * 8/2003 Cohen ..... H01Q 21/20 343/700 MS

OTHER PUBLICATIONS

Mahoney, David A. and Professor Alkim Akyurtlu, "Novel Metamaterial Polarizer," 2017 IEEE AP-S/URSI Symposium presentation. Jul. 10, 2017. 19 pages.

Mahoney, David A., "Novel Metamaterial Polarizer," 2017 IEEE AP-S/URSI Symposium abstract. Jul. 9, 2017. 1 page.

(Continued)

*Primary Examiner* — Andrea Lindgren Baltzell

(74) *Attorney, Agent, or Firm* — Finch & Maloney PLLC; Scott J. Asmus

(57) ABSTRACT

A nonplanar metamaterial polarizer includes: a substrate including dielectric material transmissive to electromagnetic radiation and having a nonplanar shape; a first conductive pattern on a first side of the substrate; and a second conductive pattern on a second side of the substrate. The first and second conductive patterns are configured to alter the polarization of the electromagnetic radiation as it transmits through the substrate. In some cases, the first and second conductive patterns include split-ring resonators, and the nonplanar shape is a cylinder. An antenna system includes the nonplanar metamaterial polarizer and an antenna inside or adjacent to the nonplanar metamaterial polarizer and configured to transmit or receive the electromagnetic radiation through the nonplanar metamaterial polarizer while the nonplanar metamaterial polarizer alters the polarization of the transmitted or received electromagnetic radiation. In some cases, the antenna is a monopole antenna, a dipole antenna, a biconical antenna, or a discone antenna.

7 Claims, 10 Drawing Sheets

(56) References Cited

OTHER PUBLICATIONS

Cheng, et al., "Compact asymmetric metamaterial circular polarization transformer based on twisted double split-ring resonator structure," Journal of Electromagnetic Waves and Applications., 2014. vol. 28, No. 4. pp. 485-493. 10 pages.
Yan, S. and A.E. Vandenbosch, "Compact circular polarizer based on chiral twisted double split-ring resonator," Applied Physics Letters 102, 103503, 2013. 4 pages.
Kunitake, Stephen, "The Design and Analysis of an Ultra-Wideband Meander-Line Polarizer for Oblique Incidence," 2016 IEEE AP-S/URSI Symposium presentation. 1 page.
Cheng, et al., "Perfect dual-band circular polarizer based on twisted split-ring structure asymmetric chiral metamaterial," Applied Optics, vol. 53, No. 25. Sep. 1, 2014. pp. 5763-5768.

* cited by examiner

The surface of the nonplanar metamaterial polarizer can be a large array composed of two layers of split-ring resonator (SRR) elements separated by a thin dielectric substrate Hexagonal
Metamaterial
Polarizer
500

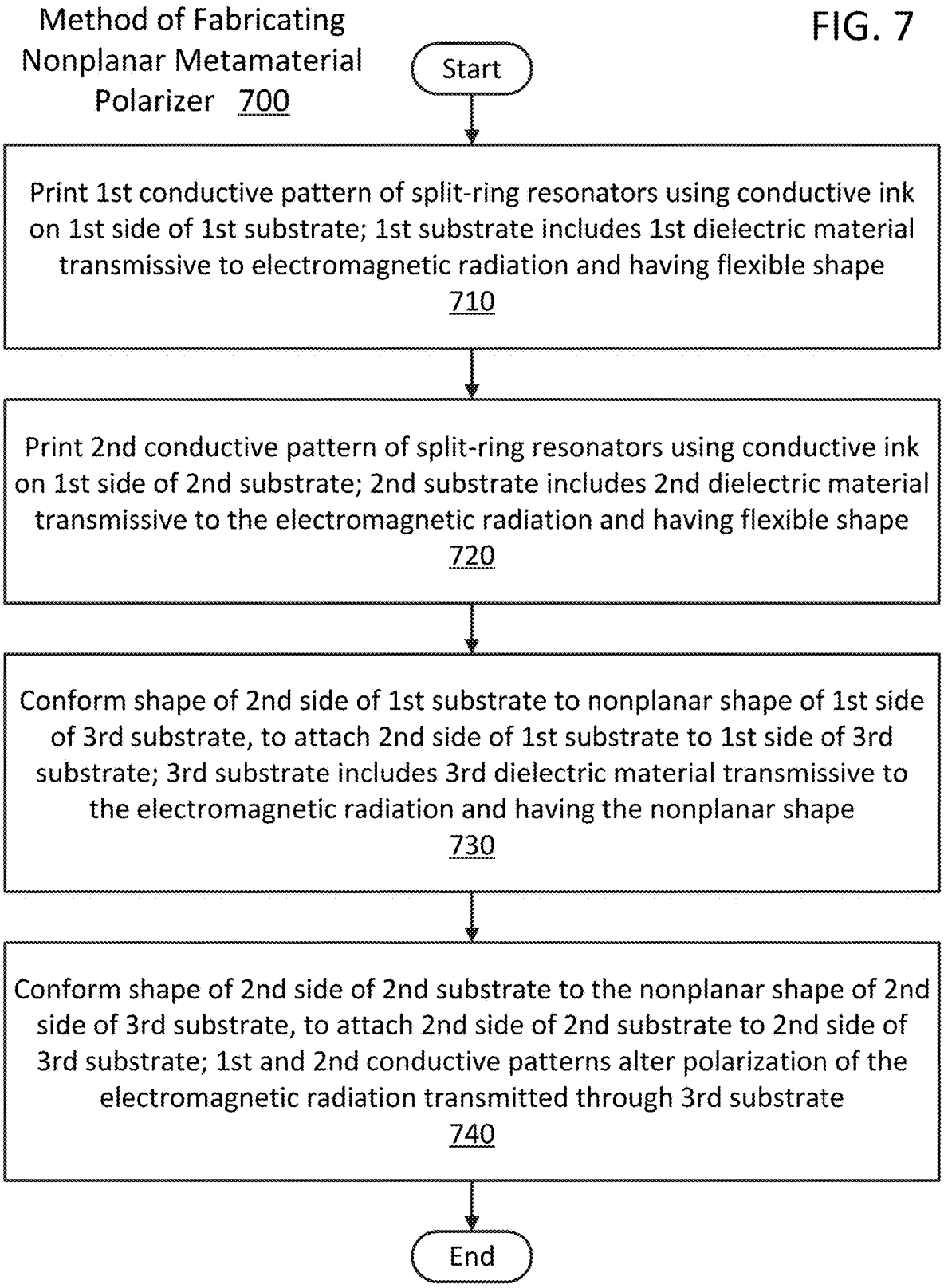
Method of Fabricating Nonplanar Metamaterial Polarizer 700
FIG. 7
Start
Print 1st conductive pattern of split-ring resonators using conductive ink on 1st side of 1st substrate; 1st substrate includes 1st dielectric material transmissive to electromagnetic radiation and having flexible shape 710
Print 2nd conductive pattern of split-ring resonators using conductive ink on 1st side of 2nd substrate; 2nd substrate includes 2nd dielectric material transmissive to the electromagnetic radiation and having flexible shape 720
Conform shape of 2nd side of 1st substrate to nonplanar shape of 1st side of 3rd substrate, to attach 2nd side of 1st substrate to 1st side of 3rd substrate; 3rd substrate includes 3rd dielectric material transmissive to the electromagnetic radiation and having the nonplanar shape 730
Conform shape of 2nd side of 2nd substrate to the nonplanar shape of 2nd side of 3rd substrate, to attach 2nd side of 2nd substrate to 2nd side of 3rd substrate; 1st and 2nd conductive patterns alter polarization of the electromagnetic radiation transmitted through 3rd substrate 740
End Method of Fabricating Nonplanar Metamaterial Polarizer
800

NONPLANAR METAMATERIAL POLARIZER AND ANTENNA SYSTEM

FIELD OF THE DISCLOSURE

This disclosure relates to a nonplanar metamaterial polarizer, such as for use with an antenna system, and to a method of fabricating the nonplanar metamaterial polarizer and antenna system.

BACKGROUND

Polarizers are structures that convert the polarization of electromagnetic waves, such as from linear polarization to circular polarization. Polarizers can be used with antennas for applications such as communication systems and radar. Such polarizers often have a planar or flat structure. However, there are applications for which a planar polarizer is not suitable.

BRIEF DESCRIPTION OF THE DRAWINGS

FIG. 7 is a flow diagram of an example method of fabricating a nonplanar metamaterial polarizer, such as the cylindrical metamaterial polarizer of FIG. 2, according to an embodiment of the present disclosure.

Figures 1A, 1B, 1C:
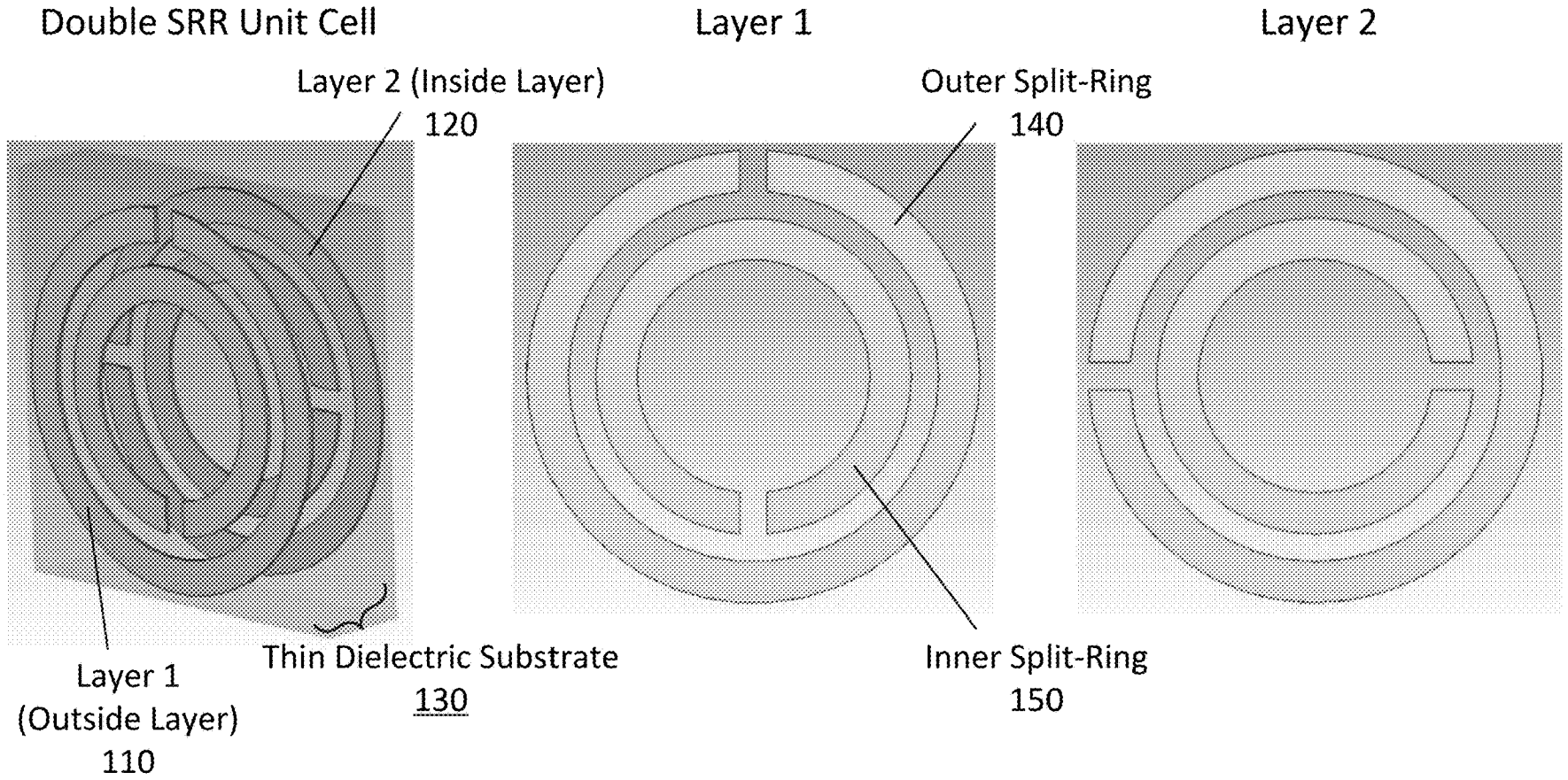
FIGS. 1A-1C are illustrations of different aspects of an example metamaterial structure used in making a nonplanar metamaterial polarizer, according to an embodiment of the present disclosure.

Although the following Detailed Description will proceed with reference being made to illustrative embodiments, many alternatives, modifications, and variations thereof will be apparent to those in light of the present disclosure.

DETAILED DESCRIPTION

According to one or more embodiments of the present disclosure, a nonplanar metamaterial polarizer and associated antenna system and method of fabricating the nonplanar metamaterial polarizer are provided. The polarizer includes a two-sided nonplanar metamaterial structure. The metamaterial structure includes a thin substrate of dielectric material that is transmissive to electromagnetic radiation and has a nonplanar shape. The metamaterial structure further includes a first conductive pattern on a first side (e.g., an outside) of the dielectric material and a second conductive pattern on a second side (e.g., an inside) of the dielectric material. The first and second conductive patterns are configured (e.g., designed and oriented) to alter the polarization of the electromagnetic radiation as it transmits through the dielectric material. In some embodiments, the dielectric material includes at least one of G10, an FR-4 material, polytetrafluoroethylene (PTFE), a polyimide (PI) film, a polycarbonate material, polyetherimide (PEI), and acrylonitrile butadiene styrene (ABS).

In one or more embodiments, cylindrical metamaterial polarizers are applied to circularly polarized antennas, such as Global Positioning System (GPS) antennas and GPS navigation systems. In some such embodiments, cylindrical metamaterial polarizers are applied to rotating projectiles or precision-guided munitions (PGMs) with GPS guidance systems. In one or more embodiments, nonplanar metamaterial polarizers are applied to frequency modulation (FM) commercial broadcasting systems. In some such embodiments, circular polarization is used for commercial FM broadcasting, such as in the 88-108 megahertz (MHz) frequency range, which allows for polarizers of reasonable size.

In some embodiments, the first and second conductive patterns include split-ring resonators. In some embodiments, the nonplanar shape includes a contoured surface, such as a cylinder. In some other embodiments, the nonplanar shape includes planar surfaces, with adjacent pairs of the planar surfaces sharing an edge where the dielectric material bends, such as a polyhedron. In one or more embodiments, the nonplanar metamaterial polarizer is part of an antenna system, which also includes an antenna inside or adjacent to the nonplanar metamaterial polarizer and configured to transmit or receive the electromagnetic radiation through the nonplanar metamaterial polarizer while the nonplanar metamaterial polarizer alters the polarization of the transmitted or received electromagnetic radiation. In some such embodiments, the antenna includes one or more of a monopole antenna, a dipole antenna, a biconical antenna, and a discone antenna.

In one or more embodiments, a method of fabricating the nonplanar metamaterial polarizer is provided. The method includes forming the first conductive pattern on the first side of a thin dielectric substrate that is transmissive to the electromagnetic radiation, and forming the second conductive pattern on the second side of the dielectric substrate. In some such embodiments, the method further includes forming the dielectric substrate into the nonplanar shape. In some such embodiments, forming the first and second conductive patterns includes printing conductive ink in the shapes of split-ring resonators. In some embodiments, forming the first and second conductive patterns and forming the dielectric substrate into the nonplanar shape are all part of an additive manufacturing process, such as three-dimensional (3D) printing, to fabricate the nonplanar metamaterial polarizer.

In some embodiments, forming the dielectric substrate into the nonplanar shape includes rolling the dielectric substrate to have a contoured surface, such as rolling the dielectric substrate to form a cylinder. In some other embodiments, forming the dielectric substrate into the nonplanar shape includes bending the dielectric substrate into planar surfaces, with adjacent planar surfaces sharing an edge where the dielectric substrate is bent. In some such embodiments, bending the dielectric substrate includes bending the dielectric substrate to form a polyhedron. In some embodiments, the method of forming the nonplanar metamaterial polarizer is part of a method of forming an antenna system. The method further includes positioning the nonplanar metamaterial polarizer around or adjacent to an antenna configured to transmit or receive the electromagnetic radiation through the nonplanar metamaterial polarizer while the nonplanar metamaterial polarizer alters the polarization of the transmitted or received electromagnetic radiation.

In some embodiments, the first and second conductive patterns are formed on the first and second sides of two (or more) dielectric substrates, and the dielectric substrates are joined to form the nonplanar metamaterial polarizer. In some such embodiments, the dielectric substrates are semicylinders, and they are joined to form a cylinder. In some embodiments, a (rigid or main) nonplanar dielectric substrate is provided, while the first and second conductive patterns are first formed on separate, flexible (e.g., thinner) substrates that are also made from a dielectric material transmissive to the electromagnetic radiation. The separate substrates are conformed (e.g., rolled, folded) to the shape of the (more rigid) nonplanar dielectric substrate to leave the first and second conductive patterns exposed while attaching the flexible substrates to the first and second sides of the main substrate.

General Overview

As mentioned above, there are applications for which a planar polarizer is not suitable. For example, planar metamaterial polarizers can have high loss and asymmetric transmission properties that severely limit their application in real-world antenna systems. For instance, planar metamaterial polarizers can have low power transmissivity, such as 50% or less, and can also be narrowband (such as only a 1-2% wavelength range). Planar metamaterial polarizers can also require a relatively long distance from the antenna source to work effectively.

Accordingly, and in one or more embodiments of the present disclosure, nonplanar metamaterial polarizers are provided. In some embodiments, the nonplanar metamaterial polarizers use split-ring resonator (SRR) elements (e.g., unit cells of two concentric rings or squares with splits or gaps on opposing sides) to, for example, convert linear polarization to circular polarization and vice versa. In some such embodiments, these metamaterial polarizers are made extremely thin (e.g., 1-3% of operating wavelength) and inexpensively by two-dimensional (2D) printing of conducting ink on substrates, and forming the substrates into the desired nonplanar shapes. In some embodiments, the printing or forming of the conductive patterns is performed on both sides of a nonplanar dielectric substrate. In some other embodiments, some of the forming of the conductive patterns takes place before forming the dielectric substrate into the desired nonplanar shape, and some of the forming of the conductive patterns takes place afterwards.

The substrates can be dielectric material, such as G10, an FR-4 material, polytetrafluoroethylene (PTFE), a polyimide (PI) material, a polycarbonate material, polyetherimide (PEI), or acrylonitrile butadiene styrene (ABS), to name a few. In some embodiments, an additive manufacturing process, such as three-dimensional (3D) printing, is used to fabricate the nonplanar metamaterial polarizers. In some embodiments, the metamaterial polarizer is formed into a nonplanar shape such as a cylinder, In some embodiments, an antenna, such as a monopole or dipole antenna, is properly configured and aligned within the polarizer (e.g., the antenna is configured to transmit or receive the wavelength or range of wavelengths of electromagnetic radiation for which the polarizer is configured to alter the polarization, the antenna is adequately spaced from the polarizer for the polarizer to work properly, and the like). In some such embodiments, the cylindrical metamaterial polarizer is used with antennas that have cylindrically symmetric radiation patterns, such as vertically oriented monopole and dipole antennas.

Because of the structural symmetry of some nonplanar metamaterial polarizers, in some embodiments when used with antennas with similarly symmetric radiation patterns, nonplanar metamaterial polarizers eliminate the asymmetric transmission properties associated with planar metamaterial polarizers and greatly reduce the transmission losses associated with planar metamaterial polarizers. This can provide for metamaterial devices that can solve real-world antenna application problems.

In one or more embodiments, cylindrical metamaterial polarizers are integrated with existing antennas (such as with conforming shapes) to provide for antenna systems without some or all the problems associated with planar metamaterial polarizers. In some such embodiments, the nonplanar metamaterial polarizers have cylindrical symmetry and low transmission losses, such as less than 10%. In some embodiments, these cylindrical metamaterial polarizers are made inexpensively, for example, by inkjet or direct write printing of conducting inks onto thin substrates. For example, the substrate thickness can be 1-3% of the operating wavelength, such as 0.44-1.32 millimeters (mm) thick for 4.4-centimeter (cm) wavelength (or 6.8 gigahertz (GHz) frequency). The thin substrates can be rolled (or otherwise formed) into cylinders and integrated with many different antenna types, such as monopole antennas, dipole antennas, discone antennas (e.g., discones), and biconical antennas (e.g., bicones), to name a few. Compared with other polarizer techniques, nonplanar (e.g., cylindrical) metamaterial polarizers can be thinner, lighter, and less expensive. According to some embodiments, these nonplanar metamaterial polarizer techniques are integrated into three-dimensional (3D) printed and honeycomb structures for use on aircraft and other military platforms.

According to some embodiments, nonplanar metamaterial polarizers are provided to conform with linearly polarized antennas to produce circularly polarized transmissions. In some embodiments, the cylindrical geometry of the polarizer can be applied to a wide range of antennas (such as dipole antennas and biconical antennas) in a compact form factor. In some such embodiments, these nonplanar metamaterial polarizers have minimal effects on the antenna gain, radiation pattern, radiation efficiency, and voltage standing wave ratio (VSWR) of the linearly polarized antennas.

In some embodiments, a metamaterial structure includes an array (or other repeating arrangement) composed of two layers of split-ring resonator (SRR) elements separated by a thin dielectric substrate. For example, each layer can include the same circular or square SRR pattern (e.g., double SRR pattern), only offset 90° relative to each other, to form an array of double SRR unit cells. In some embodiments, the array can be a large array, such as more than one wavelength long. In some embodiments, the array is smaller, such as less than one wavelength long, but longer than the corresponding antenna.

In some embodiments, a double SRR pattern is used with a vertical cylinder shape substrate, only with vertically adjacent unit cells rotated 180° with respect to each other (e.g., alternating orientation of vertical rings). In some such embodiments, a vertical dipole antenna (e.g., half the height of the polarizer) is centered in the polarizer, such as to produce left- or right-handed circularly polarized electromagnetic waves from the antenna output. For instance, in some embodiments, the nonplanar metamaterial polarizer is configured to alter the polarization of electromagnetic radiation of a particular frequency range, such as 6 gigahertz (GHz) to 9 GHz (e.g., 6.8 GHz). For example, in some such embodiments, the cylindrical metamaterial polarizer is designed to be narrowband, about 2 to 3% spread across the main frequency (such as 6.8 GHz), but has two or three resonant frequencies across a fairly wide bandwidth, such as 6 to 9 GHz.

In some embodiments, the intended frequency or frequency range is limited only by physical constraints, such as the fabrication technology (e.g., printing). According to some embodiments, the nonplanar metamaterial polarizers are lightweight, inexpensive, and environmentally robust. In some embodiments, cylindrical metamaterial polarizers are provided to convert linearly polarized antenna waves to circularly polarized waves and that have a thin, conforming profile (e.g., for wire and other conforming shape antennas).

In some example embodiments, a cylindrical metamaterial polarizer is provided. The polarizer can use a thin inexpensive construction and be applied to a variety of antenna types, such as wire antennas. In some embodiments, a thin dielectric substrate is in the shape of a cylinder or tube and centered or placed around a dipole or monopole antenna to produce, for example, a circularly polarized antenna. In some embodiments (e.g., to improve or optimize performance), the tube is longer than the antenna, such as one-and-a-half times or twice as long. The substrate is, for example, a tube of dielectric material printed with metallic (or other electrically conducting) patterns on the inside and outside of the dielectric tube.

In some embodiments, the cylinder is formed in two halves (split lengthwise), with a process such as additive printing or robocasting of conducting ink to form the conductive patterns prior to joining (e.g., adhering) the two halves to complete the cylindrical metamaterial polarizer. In some embodiments, the cylinder is formed in three or more portions (split lengthwise), such as three separate thirds or four separate quarters, and that are joined after the conductive patterns are applied to the separate portions.

The size of the polarizer can vary with intended operating frequency, such as having a 0.5-inch diameter for 10 GHz frequency (e.g., 3 cm wavelength or X-band). More generally, the diameter can be about one half the intended operating wavelength (such as between one-third and two-thirds of the intended operating wavelength). In addition, the size of the split-ring resonator (SRR) elements can vary with (e.g., be proportional to) the intended operating wavelength, such as having widths or diameters about 10% (such as 9-11%) the size of the free-space wavelength of the operating frequency. Further, the spacing between adjacent SRRs (unit cells) can vary with (e.g., proportional to) the intended operating wavelength, such as about 1-3% of the operating wavelength. In addition, the lattice spacing or pitch between adjacent SRRs (e.g., the spacing of the repeating unit cells) is about one-eighth to one-tenth of a wavelength. In some embodiments, the cylinder is only partial, such as a semi-cylinder (or half-cylinder), for antenna applications that, for instance, do not need 360° coverage, as opposed to a symmetric cylinder than can produce omnidirectional symmetric radiation patterns using, for example, a dipole or monopole antenna.

In one more embodiments, desired patterns are printed (e.g., with conductive ink) on both sides of thin dielectric (e.g., flexible polyimide) sheets, and the sheets rolled, shaped, framed, or otherwise formed into the desired nonplanar shape (e.g., cylinder). In some embodiments, the desired patterns are printed on one side of two separate dielectric substrates. The two substrates can be joined (e.g., adhered) and formed into the appropriate nonplanar shape. In some such embodiments, the two substrates are flexible and are conformed (e.g. shaped) to different sides of another substrate (such as a G10 or FR-4 tube) to attach the printed substrates to the tube while leaving the conductive patterns exposed (e.g., one pattern on the inside of the tube, and one pattern on the outside).

For example, in one or more embodiments, a 3-mil thick sheet of polyimide has the split-ring resonator (SRR) pattern (e.g., an inside SRR pattern) printed on only one side of the sheet. This sheet is rolled up in the interior of s dielectric cylinder, such as a G10 or FR-4 tube, with the conducting SRR side facing air (e.g., facing the central axis of the polarizer, such as the intended location of the antenna). In addition, an appropriate SRR pattern (e.g., an outside SRR pattern) is printed on only one side of a second 3-mil polyimide sheet. This sheet is wrapped around the outside of the dielectric cylinder, taking care to align the inner and outer patterns as precisely as possible. This outer sheet has the conducting SRR elements facing outward (e.g., adjacent to air, not the tube) and it can be held in place with, for instance, tape or adhesive. This technique is relatively easy because the 3-mil polyimide material is flexible yet has some stiffness or spring to it, so that when curled up inside the cylinder it tends to spring outward and make even contact with the inside cylinder surface.

In some other embodiments, G10 or FR-4 tubing is split in two, desired patterns printed on both sides (e.g., using one or more direct-write printing processes), and the two printed halves of the tube are joined to form a cylindrical metamaterial polarizer. In some embodiments, a similar such process is performed, only with the tubes being split into more pieces (e.g., split in thirds lengthwise, or in quarters). In some other embodiments, additive manufacturing (such as 3D printing) is used to fabricate the nonplanar metamaterial polarizers. In some embodiments, the thin printed substrate for the polarizer is formed in a tube shape having a polygonal (such as a hexagon or honeycomb) cross section. In some embodiments, several planar metamaterial portions are fabricated separately and then joined to form a nonplanar metamaterial polarizer. In one or more embodiments, the radiation pattern of the polarized radiation transmitted from the antenna through the nonplanar metamaterial polarizer is shaped by varying the polarizer structure, element patterns, and spacing, as would be apparent in light of the present disclosure. Numerous other embodiments and configurations are possible in light of the present disclosure.

System Architecture

FIGS. 1A-1C are illustrations of different aspects of an example metamaterial structure used in making a nonplanar metamaterial polarizer, according to an embodiment of the present disclosure. Metamaterial structures can be made in repeating patterns of multiple elements, in this case split-ring resonator (SRR) patterns of conductive material. The split-ring resonators include conductive material such as metal, and can be a variety of shapes, such as circular or square. Their dimensions are largely governed by the intended frequency or wavelength coverage of the electromagnetic radiation (e.g., radio waves, microwaves, infrared, to name a few) on which the polarizer is supposed to be effective. Polarizers can be used, for example, with antennas, to change the polarization of their transmitted electromagnetic radiation or the polarization of the electromagnetic radiation incident upon them. It should be noted that while for ease of illustration, the components in FIGS. 1A-1C appear to be planar, the components in some of the embodiments of the present disclosure may be contoured, curved, bent, or otherwise shaped to match the corresponding contours, curves, bends, or other nonplanar shapes of their nonplanar metamaterial polarizers.

Referring to FIGS. 1A-1C, in FIG. 1A, the SRR elements can be arranged in two-sided arrays of unit cells. Each unit cell includes a first layer 110 or layer 1 (e.g., an outer layer, such as facing away from the antenna) and a second layer 120 or layer 2 (e.g., an inner layer, such as facing towards the antenna). The orientation of the split-ring elements on the first layer 110 are rotated 90° with respect to the orientation of the split-ring elements on the second layer 120 to alter the polarization of electromagnetic radiation passing through them. For instance, radiation transmitted from the antenna can first contact the second layer 120 and then the first layer 110, with the polarization of the transmitted radiation being altered as a result. In addition, radiation received by the antenna can first contact the first layer 110 and then the second layer 120, with the polarization of the received radiation being altered as a result.

The first and second layers 110 and 120 are separated by a thin dielectric substrate 130. The substrate 130 includes dielectric material such as G10, an FR-4 material, polytetrafluoroethylene (PTFE), a polyimide (PI) material, a polycarbonate material, polyetherimide (PEI), or acrylonitrile butadiene styrene (ABS), to name a few. The dielectric material is transmissive to the radiation frequencies over which the polarizer is intended to operate. The dielectric material is available in sheets or can be pre-formed into particular shapes, such as tubes. Depending on the material and the thickness, the sheets may be flexible (such as bendable or capable of being rolled to take on a contoured appearance such as a semicylinder or a cylinder). The first and second layers 110 and 120 can be applied to the dielectric substrate 130 by, for example, printing techniques such as inkjet printing, direct write printing (e.g., additive printing, robocasting or direct ink writing, to name some), or the like can be used to print conductive ink on the dielectric substrate 130. Further, the first and second layers 110 and 120 together with the dielectric substrate 130 can be fabricated concurrently using a 3D printing or additive manufacturing technology (including robocasting).

FIG. 1B shows an example first layer SRR, including an outer split-ring 140 and an inner split-ring 150. As their names suggest, the outer and inner split-rings 140 and 150 are rings (e.g., contiguous bands of thin conductive material such as metal, metal alloy, conductive metal oxide, or the like) each having a small gap in them. The respective gaps are on opposite sides of the outer and inner split-rings 140 and 150. While the outer and inner split-rings 140 and 150 are illustrated in FIG. 1B as being circular, in other embodiments, they can be other shapes such as square, hexagonal, polygonal, or the like. FIG. 1C shows an example second layer SRR having a similar design to that of the first layer SRR, namely the split-rings are rotated (e.g., 90°) with respect to those of the first layer SRR. The arrangement of the gaps can vary (e.g., alternate) between adjacent unit cells. For example, the gap can be on the top of the outer split-ring 140 and the bottom of the inner split-ring 150 for one unit cell, and on the bottom of the outer split-ring 140 and the top of the inner split-ring 150 for an adjacent unit cell.

The dimensions of the metamaterial components and features depend primarily on the intended frequencies or wavelengths over which the metamaterial polarizer is supposed to operate effectively. For example, the unit cells should be relatively dense, such as a repeating array or other pattern with a pitch between about one-tenth and one-eighth of the intended free-space wavelength. As an example, for 6.8 GHz frequency electromagnetic waves (having 4.4 cm wavelength), the unit cells can have a pitch (distance between corresponding features of adjacent unit cells) of between 0.4 cm and 0.6 cm. The split-rings are concentric, with the outer split-ring having a size (e.g., outer dimension) between about 70% and 95% of the unit cell, and the inner split-ring having a size between about 50% and 80% of the unit cell.

Further, the separation between outer split-rings of adjacent unit cells can be about 1-3% of the intended wavelength, such as between 0.044 cm and 0.132 cm for 4.4 cm intended wavelength. The thickness of the dielectric material (e.g., separation of the first and second layers in the unit cells) can also be between about 1-3% of the intended wavelength. In some embodiments, the size of the conducting pattern (e.g., outer split-ring length or diameter) is about 10% of the operating wavelength (such as 9-11% of the operating wavelength). The size or diameter of the nonplanar metamaterial polarizer can be about half (or more) of the operating wavelength, such as between one-third and two-thirds (or between one-quarter and three-quarters). However, in some embodiments, the diameter can be as small as one-fifth or even one-sixth of the operating wavelength. There should be sufficient space between the antenna and the nonplanar metamaterial polarizer for the antenna and polarizer to work as intended.

Figure 2:
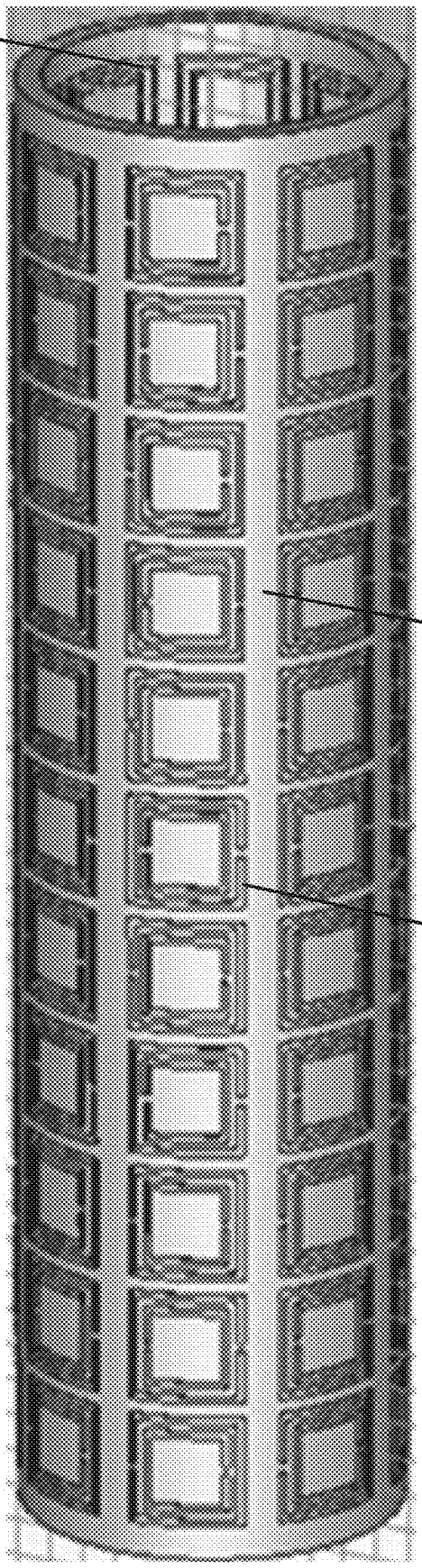
FIG. 2 is an illustration of an example cylindrical metamaterial polarizer, according to an embodiment of the present disclosure.

FIG. 2 is an illustration of an example cylindrical metamaterial polarizer 200, according to an embodiment of the present disclosure. The cylindrical metamaterial polarizer 200 has an outside conductive pattern 220 formed on the outside of a dielectric substrate 210 shaped like a cylinder. The metamaterial polarizer 200 also has an inside conductive pattern 230 formed on the inside of the dielectric substrate 210. The metamaterial polarizer 200 can be fabricated by a variety of techniques as discussed throughout, including printing both sides of a flat substrate and rolling the substrate to form a cylinder, or printing the inside pattern on a very thin dielectric sheet that can be rolled up into the inside of a dielectric tube (with the outside pattern printed similarly or, in some embodiments, directly printed on the outside of the dielectric tube), or printing both sides of semicylinders (or smaller portions of a cylinder) and joining the semicylinders (or smaller portions) together, or similar technique or combination of techniques, as would be apparent in light of the present disclosure.

In general, the cylindrical metamaterial polarizer 200 and other nonplanar metamaterial polarizers and antenna systems disclosed herein may be custom hardware devices or built from commercially available supplies and tools, as would be appreciated in light of this disclosure. While the various polarizers and antennas are illustrated as single components, in some embodiments, they are multiple separately-fabricated subcomponents attached or otherwise joined to function as a single component. As will be appreciated, a polarizer or other device as used herein is a physical structure capable of carrying out one or more functionalities as variously provided herein. For example, the structures can include custom or purpose-built components (such as conductive patterns on dielectric substrates, or antenna structures (such as iteratively designed or commercially available antenna structures) to match the various nonplanar metamaterial polarizers discussed herein, with discrete components configured and arranged to carry out the various functionalities provided herein. Numerous such embodiments and configurations will be appreciated in light of this disclosure.

Figure 3:
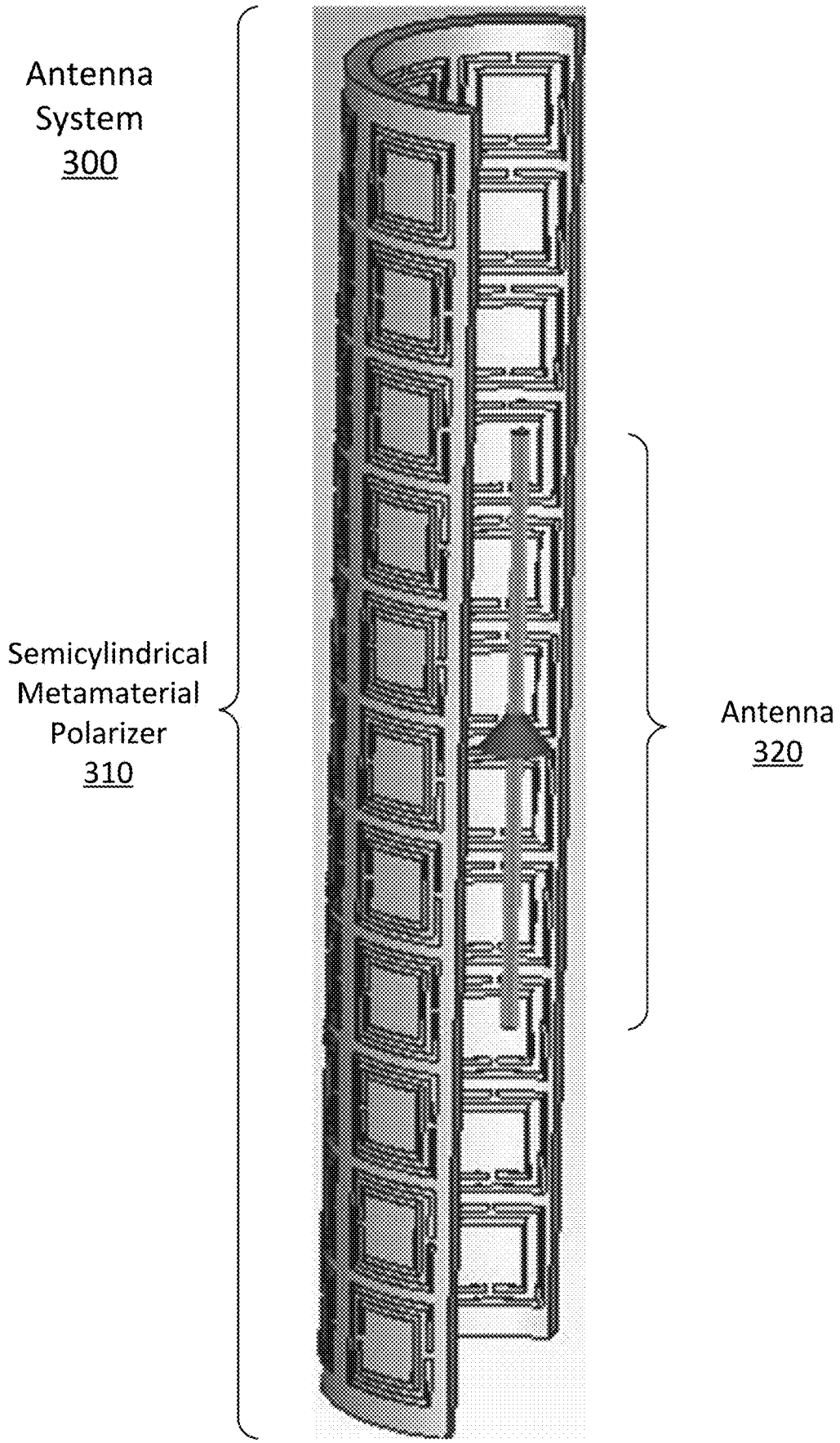
FIG. 3 is an illustration of an example antenna system including a semicylindrical metamaterial polarizer and an antenna, according to an embodiment of the present disclosure.

FIG. 3 is an illustration of an example antenna system 300 including a semicylindrical metamaterial polarizer 310 and an antenna 320, according to an embodiment of the present disclosure. The semicylindrical metamaterial polarizer 310 can be fabricated, for example, using techniques similar to those discussed above. In some embodiments, the semicylindrical metamaterial polarizer 310 is fabricated by printing the conductive patterns directly on both sides of a half-tube of dielectric material using conductive ink. The antenna 320 can be, for example, a monopole or dipole antenna configured to operate with the metamaterial polarizer 310. For instance, the antenna 320 can be configured to transmit or receive electromagnetic radiation in the designed frequency range of the metamaterial polarizer 310.

The antenna 320 can also be oriented properly to receive or transmit the appropriate frequencies, such as maintaining sufficient spacing between the antenna element and the polarizer (e.g., at least 8-10% of the operating wavelength, such as at least 0.35 cm for a 4.4 cm wavelength), matching the broadcasting or reception pattern with the polarizing pattern, keeping the antenna sufficiently inside the polarizer (e.g., centered in the polarizer, with a length no more than half or two-thirds the length of the polarizer), and the like. For instance, the antenna can be configured to transmit or receive electromagnetic radiation while the nonplanar metamaterial polarizer alters the polarization of the transmitted or received electromagnetic radiation.

In general, any of the nonplanar metamaterial polarizers discussed or disclosed herein can be configured as an antenna system with a corresponding antenna (such as a monopole antenna, a dipole antenna, a biconical antenna, or a discone antenna, to name a few) to transmit or receive electromagnetic radiation though the nonplanar metamaterial polarizer. For example, an existing commercial antenna can have a more custom nonplanar metamaterial polarizer match it, or an already-built nonplanar metamaterial polarizer (as disclosed herein) can have a custom antenna configured to operate with it, or an iterative process can be used to match the nonplanar metamaterial polarizer with the antenna (e.g., customizing each component in stages until they function together as intended), or some such technique. Further elements of the antenna system (e.g., conductive leads and resistors to operate the antenna, structures to fix or adjust the position of the antenna with respect to the nonplanar metamaterial polarizer, and the like) may be omitted herein for ease of description, but would be present in a functioning antenna system, as would be appreciated in light of this disclosure.

Figures 4A, 4B:
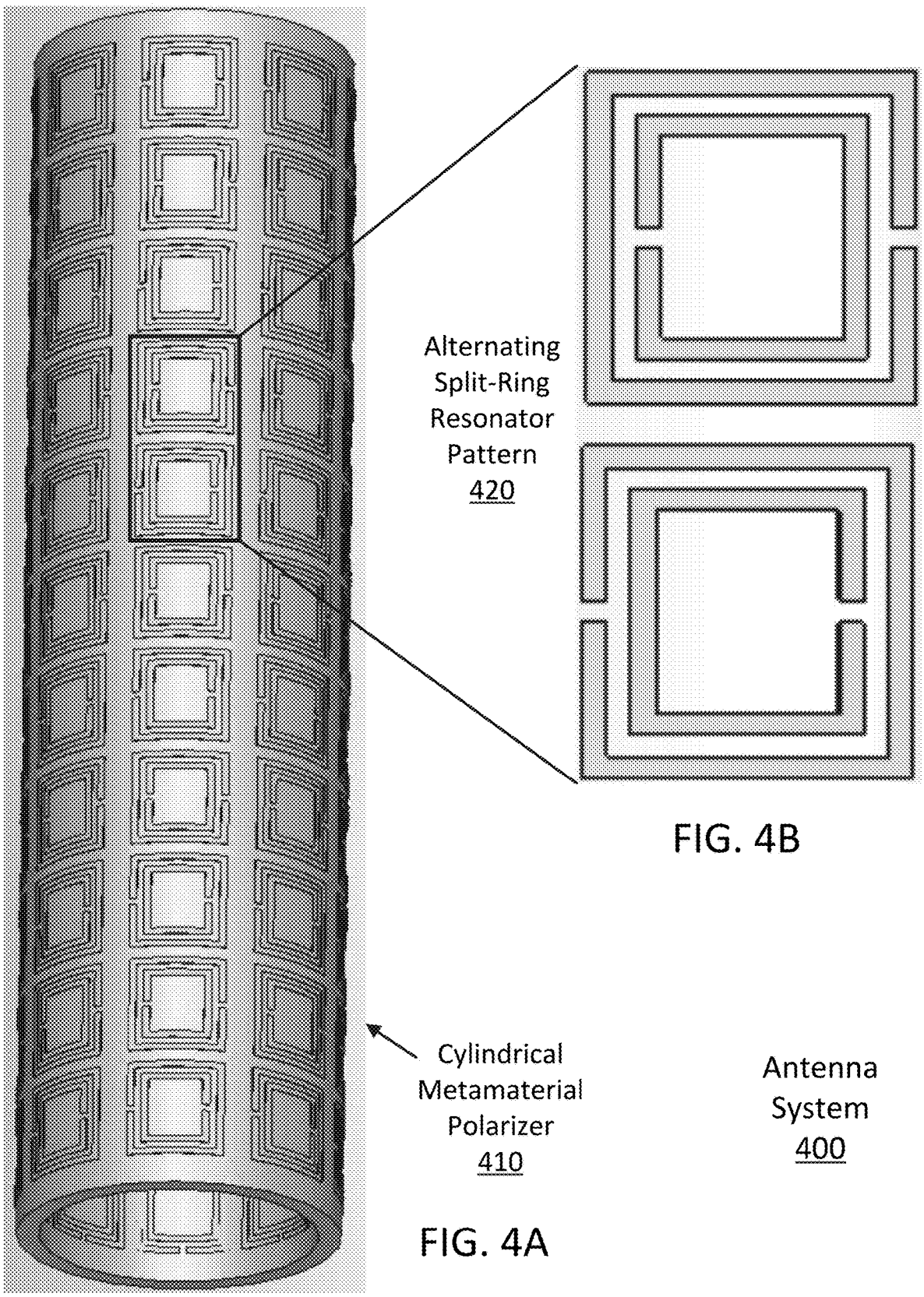
FIGS. 4A-4C are illustrations of different aspects of an example antenna system including a cylindrical metamaterial polarizer and an antenna, according to an embodiment of the present disclosure.
Figure 4C:
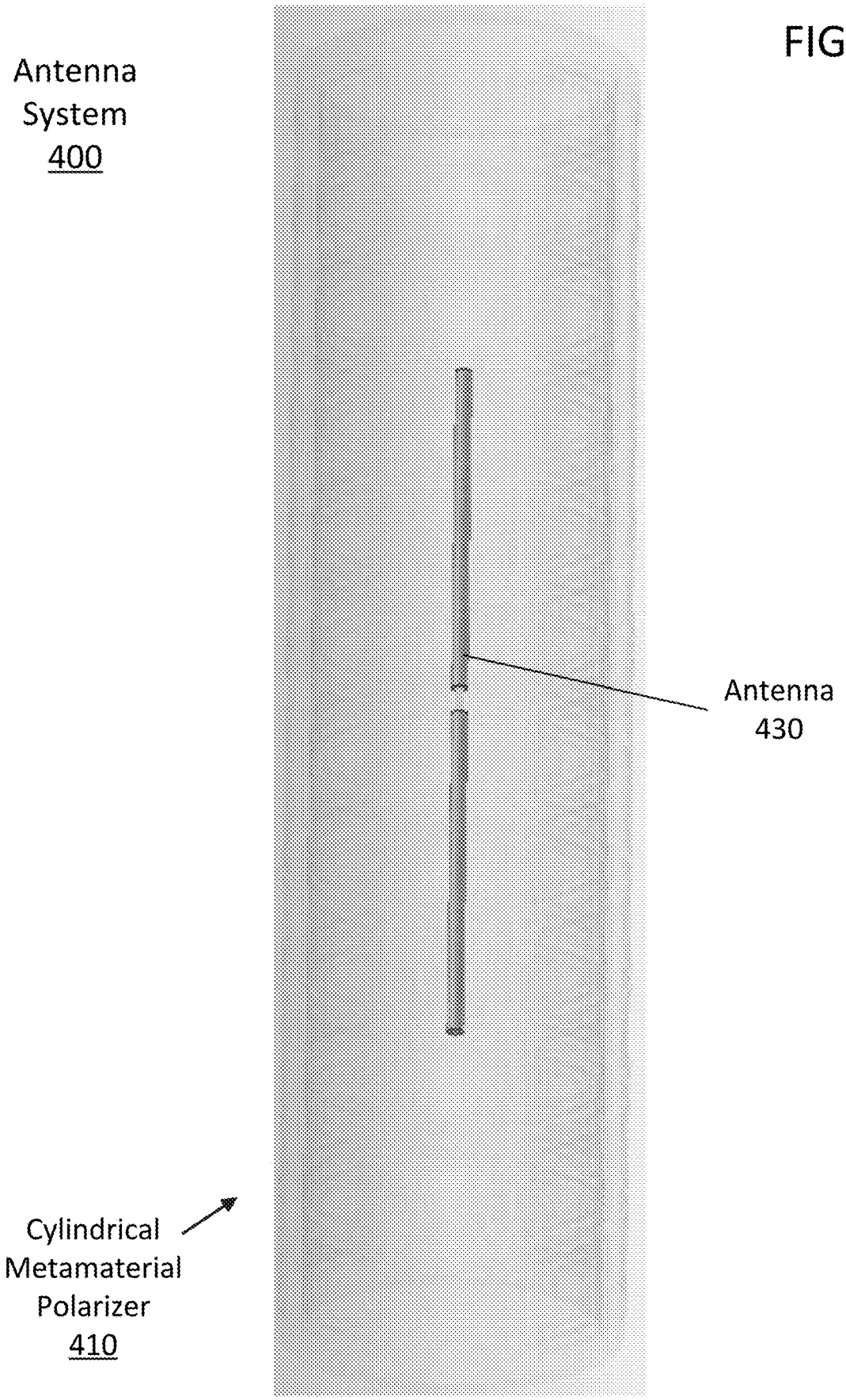

FIGS. 4A-4C are illustrations of different aspects of an example antenna system 400 including a cylindrical metamaterial polarizer 410 and an antenna 430, according to an embodiment of the present disclosure. In addition to the structure, features, and fabrication techniques discussed, for example, with reference to the cylindrical metamaterial polarizer 200, the cylindrical metamaterial polarizer 410 in FIG. 4A includes an alternating split-ring resonator (SRR) pattern 420 using square-shaped split-rings whose outside gap pattern alternates vertically between adjacent unit cells, as illustrated in FIG. 4B. FIG. 4C shows a cutaway view of the antenna system 400, where the cylindrical metamaterial polarizer 410 is shown mostly transparent to expose the antenna 430 (such as a monopole or dipole antenna) inside the cylindrical metamaterial polarizer 410.

Figure 5:
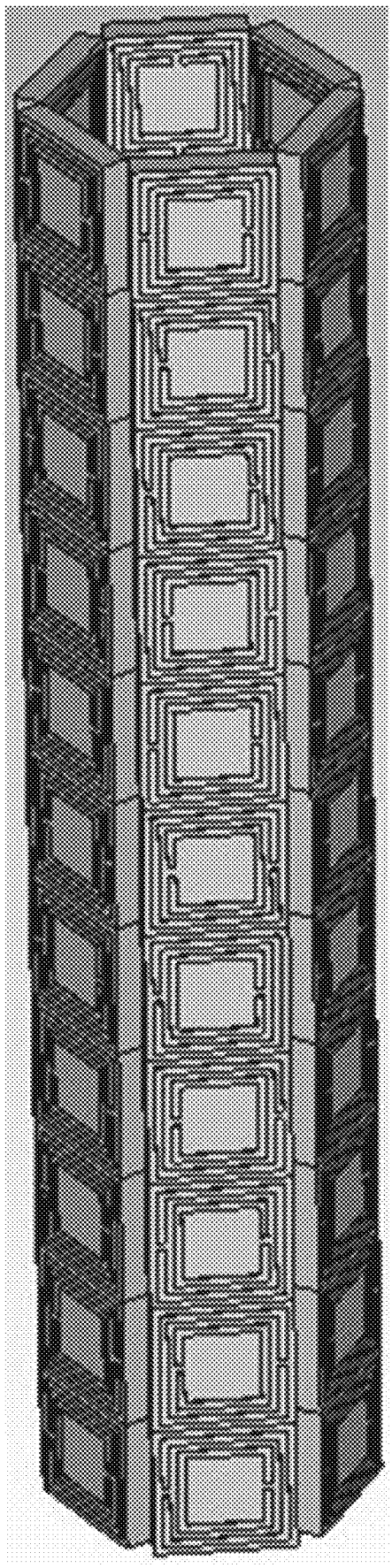
FIG. 5 is an illustration of an example hexagonal metamaterial polarizer that can be used as a component in a honeycomb structure, according to an embodiment of the present disclosure.

FIG. 5 is an illustration of an example hexagonal metamaterial polarizer 500 that can be used, for instance, as a component in a honeycomb structure, according to an embodiment of the present disclosure. The nonplanar metamaterial polarizers disclosed do not have to have a contoured surface (such as a cylinder or semicylinder). For example, in some embodiments, the nonplanar shape is a polyhedron, such as the honeycomb metamaterial polarizer 500 having a hexagonal cross section. In addition to the fabrication techniques disclosed above in reference to the cylindrical and semicylindrical metamaterial polarizers, other techniques can be applied to fabricating polyhedral metamaterial polarizers like the honeycomb metamaterial polarizer 500. For example, in one embodiment, the (six) sides of the honeycomb metamaterial polarizer 500 can be fabricated separately as planar sheets with double-sided printing, and then joined (e.g., adhered) together to form the honeycomb metamaterial polarizer 500. In another embodiment, a single sheet of (bendable) dielectric substrate can have the conductive patterns printed on both sides, and then the printed sheet bent to form a honeycomb.

Methodology

Figure 6:
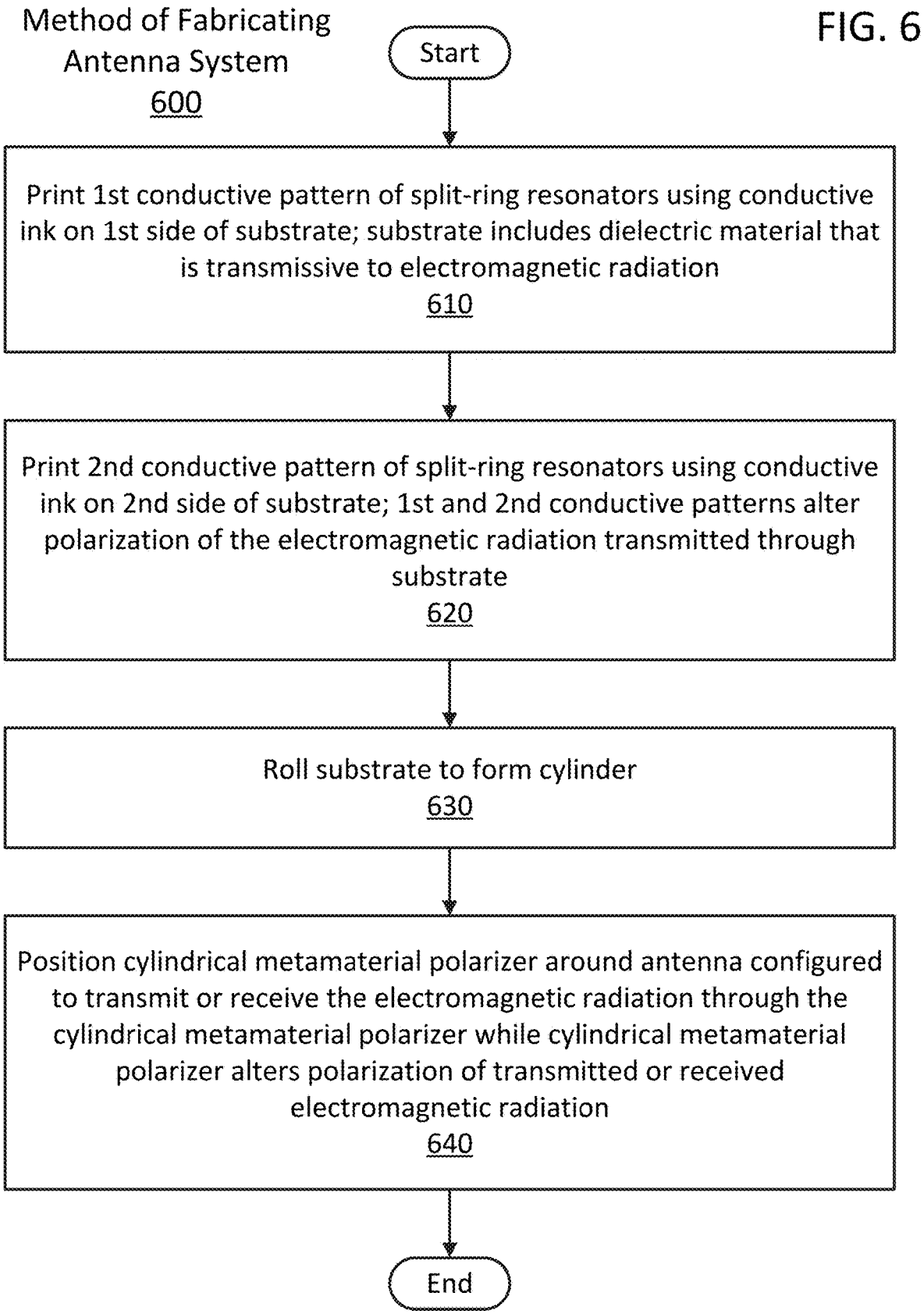
FIG. 6 is a flow diagram of an example method of fabricating an antenna system including a cylindrical metamaterial polarizer, such as the antenna system in FIGS. 4A-4C, according to an embodiment of the present disclosure.

FIG. 6 is a flow diagram of an example method 600 of fabricating an antenna system including a cylindrical metamaterial polarizer, such as the antenna system 400 in FIGS. 4A-4C, according to an embodiment of the present disclosure. The method 600 (and other methods disclosed herein) may be performed, for example, by automated tools such as 2D or 3D printing tools, as would apparent in light of this disclosure. Such tools can include, for example, inkjet or direct-write (such as additive printing or robocast) printing tools using conductive ink on commercially available dielectric substrates and substrate materials such as G10, FR-4, PTFE, polyimide, polycarbonate, polyetherimide, or ABS, to name a few. Throughout the description of the method 600, references may be made to corresponding components of the nonplanar metamaterial components, polarizers, and antenna systems of FIGS. 1-5. In addition, while the methods described herein may appear to have a certain order to their operations, other embodiments may not be so limited. Accordingly, the order of the operations can be varied between embodiments, as would be apparent in light of this disclosure. Numerous such embodiments and configurations will be appreciated in light of this disclosure.

Referring to the method 600 of FIG. 6, fabrication begins with printing 610 a first conductive pattern (such as outside conductive pattern 220) of split-ring resonators (such as alternating split-ring resonator pattern 420) using conductive ink on a first side (such as a top or outside) of a substrate (such as dielectric substrate 210). The substrate includes dielectric material transmissive to electromagnetic radiation (such as microwaves or radio waves that need to be polarized, unpolarized, or otherwise have their polarization altered). The method 600 further includes printing 620 a second conductive pattern (such as inside conductive pattern 230) of split-ring resonators using conductive ink on a second side (such as a bottom or inside) of the substrate. The first and second conductive patterns are configured to alter the polarization of the electromagnetic radiation as it transmits through the substrate.

The method 600 further includes rolling 630 the substrate to form a cylinder (such as cylindrical metamaterial polarizer 410). In addition, the method 600 further includes positioning 640 (such as aligning) the cylindrical metamaterial polarizer around an antenna (such as antenna 430) configured to transmit or receive the electromagnetic radiation through the cylindrical metamaterial polarizer while the cylindrical metamaterial polarizer alters the polarization of the transmitted or received electromagnetic radiation. In a variation of the method 600, instead of rolling 630 the substrate to form a cylinder, the method includes bending the substrate to form a polyhedron (such as honeycomb metamaterial polarizer 500).

FIG. 7 is a flow diagram of an example method of fabricating a nonplanar metamaterial polarizer, such as the cylindrical metamaterial polarizer 200 of FIG. 2, according to an embodiment of the present disclosure. The method 700 can be performed using the same or similar techniques as those discussed above for the method 600. As such, reference in the method 700 to the same named components, structures, or techniques of the method 600 may be implemented with the same components, structures, or techniques referred to in the description of the method 600.

Referring to the method 700 of FIG. 7, processing begins with printing 710 a first conductive pattern (such as inside conductive pattern 230) of split-ring resonators using conductive ink on a first side of a first substrate. The first substrate includes first dielectric material transmissive to electromagnetic radiation and having a flexible shape. For example, the first substrate can be a 3-mil thick sheet of polyimide material. The method 700 further includes printing 720 a second conductive pattern of split-ring resonators using conductive ink on a first side of a second substrate. The second substrate includes second dielectric material transmissive to the electromagnetic radiation and having a flexible shape. For example, the second substrate can also be a 3-mil thick sheet of polyimide material.

The method 700 further includes conforming 730 the shape of the second side of the first substrate to the nonplanar shape (such as a cylinder) of a first side of a third substrate (such as the dielectric substrate 210) to attach the second side of the first substrate to the first side of the third substrate. The third substrate includes third dielectric material transmissive to the electromagnetic radiation and having the nonplanar shape (e.g., cylindrical). For example, the third substrate can be a rigid tube of G10 or FR-4 material, and the conforming 730 can include rolling the printed flexible polyimide sheet and fitting the rolled polyimide sheet inside the tube so that the printed side is exposed (e.g., not against the inside of the tube). At 3-mil thick, the rolled polyimide sheet should have enough tension to stick to the inside of the tube.

The method 700 further includes conforming 740 the shape of the second side of the second substrate to the nonplanar shape of the second side of the third substrate, to attach the second side of the second substrate to the second side of the third substrate. For example, the conforming 740 can include rolling the printed flexible polyimide sheet around the tube and adhering the sheet to the tube (e.g., with tape or adhesive) so that the printed side is exposed (e.g., not against the outside of the tube). The conforming 740 further includes aligning the second conductive pattern with the first conductive pattern so that the first and second conductive patterns alter the polarization of the electromagnetic radiation transmitted through the third substrate.

Figure 8:
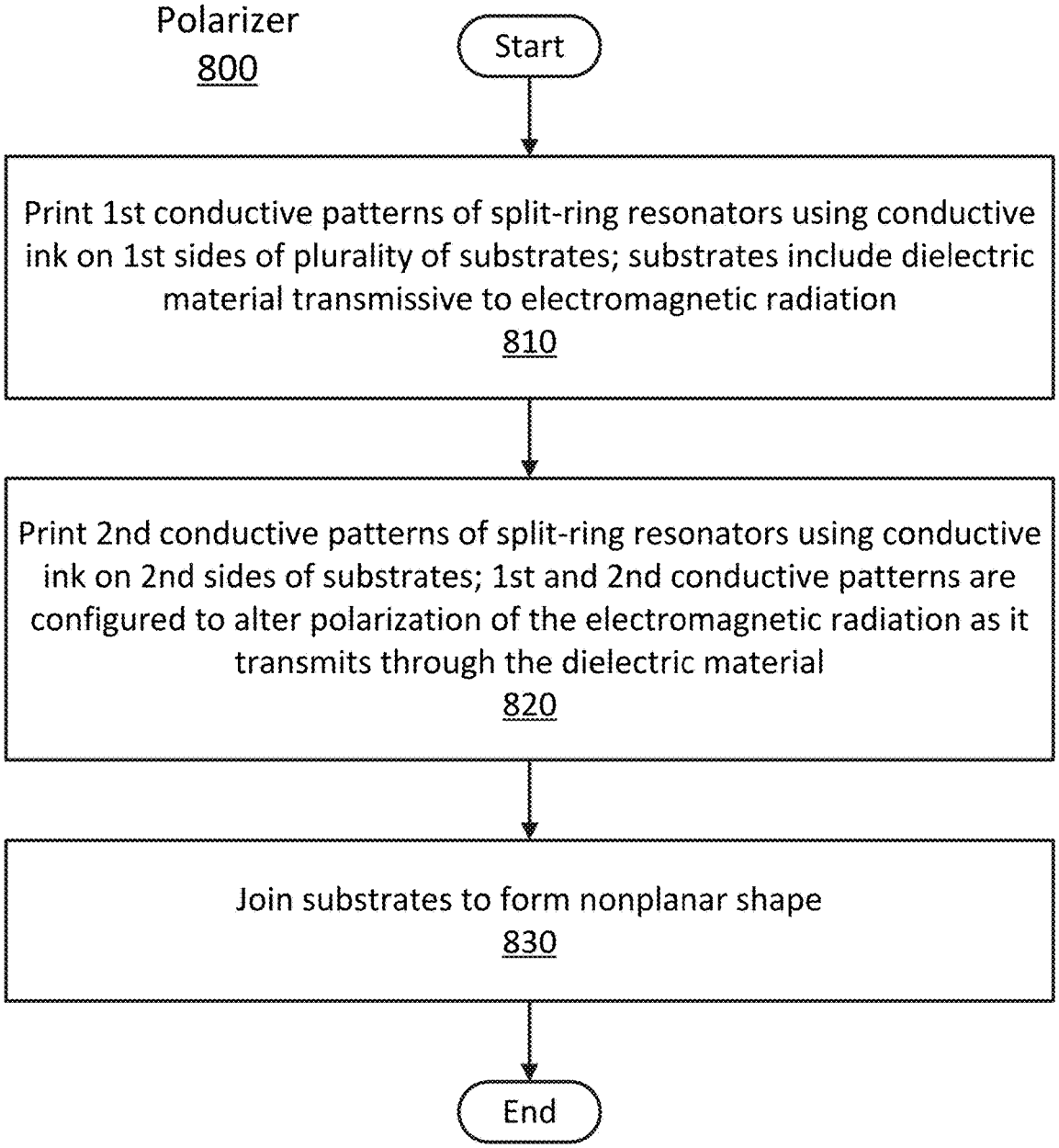
FIG. 8 is a flow diagram of an example method of fabricating a nonplanar metamaterial polarizer, such as the honeycomb metamaterial polarizer of FIG. 5, according to another embodiment of the present disclosure.

FIG. 8 is a flow diagram of an example method of fabricating a nonplanar metamaterial polarizer, such as the honeycomb metamaterial polarizer 500 of FIG. 5, according to another embodiment of the present disclosure. The method 800 can be performed using the same or similar techniques as those discussed above for the methods 600 and 700. As such, reference in the method 800 to the same named components, structures, or techniques of the methods 600 or 700 may be implemented with the same components, structures, or techniques referred to in the descriptions of the methods 600 and 700.

Referring to the method 800 of FIG. 8, processing begins with printing 810 first conductive patterns of split-ring resonators using conductive ink on first sides of a plurality of substrates. The substrates include dielectric material transmissive to electromagnetic radiation. The method 800 further includes printing 820 second conductive patterns of split-ring resonators using conductive ink on second sides of the substrates. The first and second conductive patterns are configured to alter the polarization of the electromagnetic radiation as it transmits through the dielectric material. The method 800 further includes joining 830 (e.g., adhering) the substrates to form a nonplanar shape. For example, the substrates can be planar, and the substrates can be joined to form a polyhedron, such as a honeycomb (e.g., the honeycomb metamaterial polarizer 500). In a variation of the method 800, instead of forming the substrates as planar shapes, they can be formed as semicylinders (or other lengthwise divisions of a cylinder) and joined together to form a cylinder.

Numerous other methods and techniques will be apparent in light of the present disclosure.

Example Embodiment

Figure 9A:
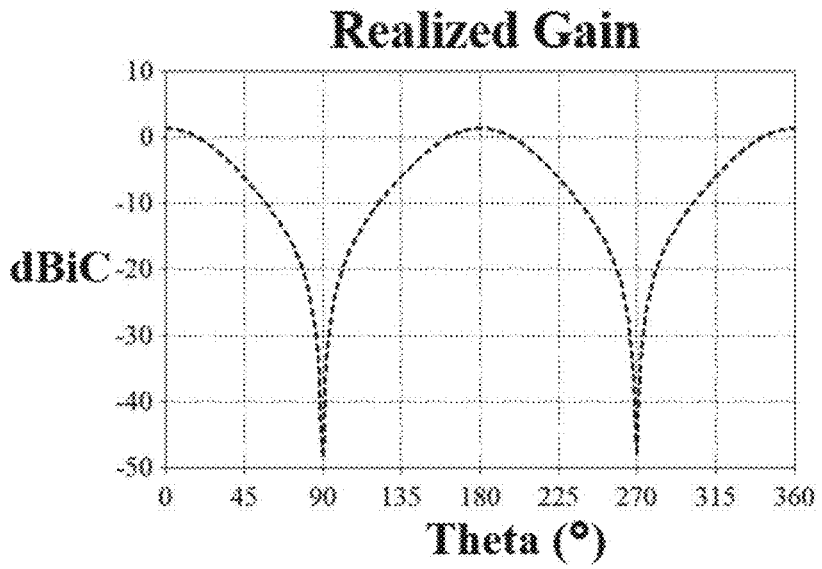
FIGS. 9A-9B are graphs illustrating calculated 2D-elevation realized far field gain and axial ratio patterns at a frequency of 6.95 GHz for an example antenna system, according to an embodiment of the present disclosure.
Figure 9B:
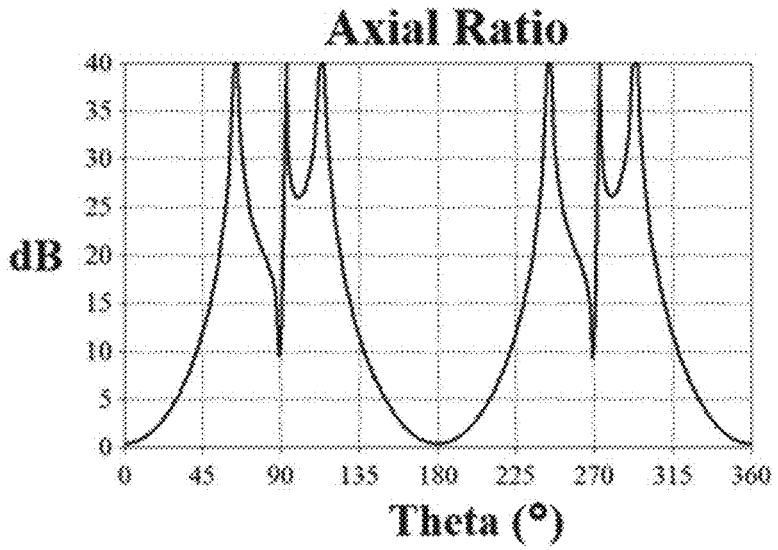
Figure 9C:
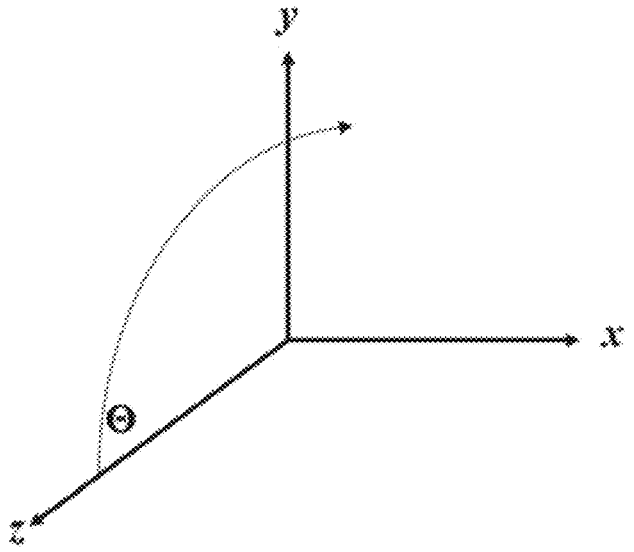
FIG. 9C illustrates a coordinate system showing an example definition of the elevation angle theta (Θ) in FIGS. 9A-9B, according to an embodiment of the present disclosure.

FIGS. 9A-9B are graphs illustrating calculated 2D-elevation realized far field gain and axial ratio patterns at a frequency of 6.95 GHz for an example antenna system, according to an embodiment of the present disclosure. FIG. 9C illustrates a coordinate system showing an example definition of the elevation angle theta (Θ) in FIGS. 9A-9B, according to an embodiment of the present disclosure.

In FIGS. 9A-9C, a specific antenna system according to an embodiment and including a dipole antenna and cylindrical metamaterial polarizer (such as a polarizer the general design of the cylindrical metamaterial polarizer 200 shown in FIG. 2) is considered. The polarizer includes an FR-4 tube with square split-ring resonator element arrays on its inner and outer surfaces. The FR-4 tube has an inner diameter of 8.97 mm, an outer diameter of 10.39 mm, and a length of 41.6 mm. Each split-ring resonator element array includes 12 rings, each with 8 SRR elements. The dipole antenna is treated as a perfect electric conductor and is excited by an ideal voltage source at its center. The dipole diameter is 0.5 mm, length is 21 mm, and the feed gap between the top and bottom dipole segments is 0.8 mm. The realized far field gain and axial ratio are calculated with a commercially available 3D electromagnetic solver to demonstrate that the polarizer converts the dipole's radiation from linear to circular polarization.

The calculated 2D-elevation realized far field gain (in decibels isotropic circular, or dBiC) and axial ratio patterns (in decibels, or dB) at a frequency of 6.95 GHz are shown in FIGS. 9A-9B. The coordinate system showing the definition of the elevation angle Θ is shown in FIG. 9C. The radiation is left-hand circularly polarized and the peak realized gain is 1.34 dBiC on the horizon. The lowest axial ratio has a value of 0.43 dB and occurs at the horizon, theta (Θ)=180°.

FURTHER EXAMPLE EMBODIMENTS

The following examples pertain to further embodiments, from which numerous permutations and configurations will be apparent.

Example 1 is a nonplanar metamaterial polarizer including: a substrate including dielectric material transmissive to electromagnetic radiation and having a nonplanar shape; a first conductive pattern on a first side of the substrate; and a second conductive pattern on a second side of the substrate, wherein the first and second conductive patterns are configured to alter the polarization of the electromagnetic radiation as it transmits through the substrate.

Example 2 includes the nonplanar metamaterial polarizer of Example 1, wherein the dielectric material includes at least one of G10, an FR-4 material, polytetrafluoroethylene (PTFE), a polyimide (PI) material, a polycarbonate material, polyetherimide (PEI), and acrylonitrile butadiene styrene (ABS).

Example 3 includes the nonplanar metamaterial polarizer of Example 1, wherein the first and second conductive patterns include split-ring resonators.

Example 4 includes the nonplanar metamaterial polarizer of Example 1, wherein the nonplanar shape includes at least one of: a contoured surface; and planar surfaces, adjacent such planar surfaces sharing an edge where the substrate bends.

Example 5 includes the nonplanar metamaterial polarizer of Example 4, wherein the nonplanar shape includes at least one of a cylinder and a polyhedron.

Example 6 is an antenna system including: the nonplanar metamaterial polarizer of Example 1; and an antenna inside or adjacent to the nonplanar metamaterial polarizer and configured to transmit or receive the electromagnetic radiation through the nonplanar metamaterial polarizer while the nonplanar metamaterial polarizer alters the polarization of the transmitted or received electromagnetic radiation.

Example 7 includes the antenna system of Example 6, wherein the antenna includes one or more of a monopole antenna, a dipole antenna, a biconical antenna, and a discone antenna.

Example 8 is a method of fabricating a nonplanar metamaterial polarizer, the method including: forming a first conductive pattern on a first side of a substrate, the substrate including dielectric material transmissive to electromagnetic radiation; and forming a second conductive pattern on a second side of the substrate, wherein the substrate has a nonplanar shape and the first and second conductive patterns are configured to alter the polarization of the electromagnetic radiation as it transmits through the substrate.

Example 9 includes the method of Example 8, wherein the forming of the first and second conductive patterns are part of an additive manufacturing process to fabricate the nonplanar metamaterial polarizer.

Example 10 includes the method of Example 8, further including forming the substrate into the nonplanar shape.

Example 11 includes the method of Example 10, wherein forming the substrate into the nonplanar shape includes at least one of: rolling the substrate to form a contoured surface; and bending the substrate to form planar surfaces, adjacent such planar surfaces sharing an edge where the substrate is bent.

Example 12 includes the method of Example 10, wherein forming the substrate into the nonplanar shape includes at least one of: rolling the substrate to form a cylinder; and bending the substrate to form a polyhedron.

Example 13 includes the method of Example 8, wherein the substrate is a first substrate, the method further including: forming the first conductive pattern on a first side of a second substrate, the second substrate including the dielectric material; forming the second conductive pattern on a second side of the second substrate; and joining the first and second substrates.

Example 14 includes the method of Example 13, wherein the first and second substrates are semicylinders, and the nonplanar metamaterial polarizer is a cylinder.

Example 15 includes the method of Example 8, wherein forming the first and second conductive patterns includes printing conductive ink on the first and second sides of the substrate to from split-ring resonators.

Example 16 is a method of forming an antenna system, the method including: forming the nonplanar metamaterial polarizer using the method of Example 8; and positioning the nonplanar metamaterial polarizer around or adjacent to an antenna configured to transmit or receive the electromagnetic radiation through the nonplanar metamaterial polarizer while the nonplanar metamaterial polarizer alters the polarization of the transmitted or received electromagnetic radiation.

Example 17 includes the method of Example 8, wherein the substrate is a first substrate, the dielectric material is a first dielectric material, and forming the first conductive pattern on the first side of the first substrate includes: forming the first conductive pattern on a first side of a second substrate, the second substrate including a second dielectric material transmissive to the electromagnetic radiation and having a flexible shape; and conforming the shape of a second side of the second substrate to the nonplanar shape of the first side of the first substrate, to attach the second side of the second substrate to the first side of the first substrate.

Example 18 includes the method of Example 17, wherein forming the second conductive pattern on the second side of the first substrate includes: forming the second conductive pattern on the first side of a third substrate, the third substrate including a third dielectric material transmissive to the electromagnetic radiation and having a flexible shape; and conforming the shape of a second side of the third substrate to the nonplanar shape of the second side of the first substrate, to attach the second side of the third substrate to the second side of the first substrate.

Example 19 is a method of fabricating a nonplanar metamaterial polarizer, the method including: forming first conductive patterns on first sides of a plurality of substrates, the substrates including dielectric material transmissive to electromagnetic radiation; forming second conductive patterns on second sides of the substrates; and joining the substrates to form a nonplanar shape, wherein the first and second conductive patterns are configured to alter the polarization of the electromagnetic radiation as it transmits through the dielectric material.

Example 20 includes the method of Example 19, wherein the substrates are flat and the nonplanar shape is a polyhedron, or the substrates are contoured and the nonplanar shape is a cylinder.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. In addition, various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not be this detailed description, but rather by the claims appended hereto. Future filed applications claiming priority to this application may claim the disclosed subject matter in a different manner, and may generally include any set of one or more elements as variously disclosed or otherwise demonstrated herein.

What is claimed is:

1. A nonplanar metamaterial polarizer comprising:

a substrate comprising a dielectric material transmissive to electromagnetic radiation and having a nonplanar shape;

a first conductive pattern on a first side of the substrate; and a second conductive pattern on a second side of the substrate, wherein the first and second conductive patterns are configured to alter the polarization of the electromagnetic radiation as it transmits through the substrate.

2. The nonplanar metamaterial polarizer of claim 1, wherein the dielectric material comprises at least one of G10, an FR-4 material, polytetrafluoroethylene (PTFE), a polyimide (PI) material, a polycarbonate material, polyetherimide (PEI), and acrylonitrile butadiene styrene (ABS).

3. The nonplanar metamaterial polarizer of claim 1, wherein the first and second conductive patterns comprise a plurality of split-ring resonators.

4. The nonplanar metamaterial polarizer of claim 1, wherein the nonplanar shape comprises at least one of:

a contoured surface; and planar surfaces, wherein adjacent pairs of the planar surfaces share an edge where the substrate bends.

5. The nonplanar metamaterial polarizer of claim 4, wherein the nonplanar shape comprises at least one of a cylinder and a polyhedron.

6. An antenna system comprising:

the nonplanar metamaterial polarizer of claim 1; and an antenna inside or adjacent to the nonplanar metamaterial polarizer and configured to transmit or receive the electromagnetic radiation through the nonplanar metamaterial polarizer while the nonplanar metamaterial polarizer alters the polarization of the transmitted or received electromagnetic radiation.

7. The antenna system of claim 6, wherein the antenna comprises one or more of a monopole antenna, a dipole antenna, a biconical antenna, and a discone antenna.

* * * * *